United States Patent [19]

Akkerman

[11] Patent Number: 4,540,047

[45] Date of Patent: Sep. 10, 1985

[54] FLOW CONTROLLING APPARATUS

[75] Inventor: Neil H. Akkerman, Kingwood, Tex.

[73] Assignee: AVA International Corporation, Houston, Tex.

[21] Appl. No.: 513,392

[22] Filed: Jul. 14, 1983

Related U.S. Application Data

[63] Continuation of Ser. No. 233,628, Feb. 17, 1981, abandoned.

[51] Int. Cl.[3] ..... E21B 23/03; E21B 33/12; E21B 34/10; E21B 34/16

[52] U.S. Cl. ..... 166/188; 166/117.5; 166/131; 166/133; 166/184; 166/325

[58] Field of Search ..... 166/117, 117.5, 129, 166/130, 133, 183, 188, 184, 185, 196, 319, 321, 322

[56] References Cited

U.S. PATENT DOCUMENTS

| | | | |
|---|---|---|---|
| 2,982,357 | 5/1961 | Kenneday | 166/129 X |
| 3,375,874 | 4/1968 | Cherry et al. | 166/321 X |
| 3,627,042 | 12/1971 | McGowen, Jr. et al. | 166/322 |
| 3,666,012 | 5/1972 | Sizer et al. | 166/319 |
| 3,701,382 | 10/1972 | Williams | 166/196 |
| 3,993,129 | 11/1976 | Watkins | 166/319 |
| 4,239,082 | 12/1980 | Terral | 166/117.5 |
| 4,249,599 | 2/1981 | Krause | 166/319 X |

*Primary Examiner*—Stephen J. Novosad

*Attorney, Agent, or Firm*—Vaden, Eickenroht, Thompson, Bednar & Jamison

[57] ABSTRACT

This application discloses apparatus in which a body means having a bore therethrough connected as part of a tubing string is packed off within a well bore, and means including a passageway in the body means bypasses the packer to connect the annulus about the tubing string above and below the packer. The packer is expanded into engagement with the well bore upon release of a means for locking it in an inoperative position, and a means for so releasing the locking means includes a piston in the passageway which in responsive to control fluid supplied through a control line in the annulus which connects with the passageway. Upon release and setting of the packer, the piston is removed from the passageway and circulation of well fluid through the connecting means between the annulus above and below the packer is controlled by a safety valve which normally closes the passageway, but which is responsive to control fluid supplied thereto through the same control line. Each of the means for connecting the control line with the passageway in order to release the packer, and alternatively establishing safety valve controlled circulation of well fluid through the connecting means comprise tools which are alternately landed within and retrieved from a pocket formed in the body means to one side of its bore.

56 Claims, 19 Drawing Figures

4
4
56
51
T-1
5
5
55
18
52
46
6
6
57
47
53
46
7
7
54
44
19

FLOW CONTROLLING APPARATUS

This is a continuation of application Ser. No. 233,628, filed Feb. 17, 1981, entitled "Flow Controlling Apparatus", now abandoned.

This invention relates in general to apparatus of the type in which body means having a bore therethrough connected as part of the tubing string is packed off within the well bore, and flow through a passageway in the body means which bypasses the packer to connect the annulus about the tubing string above and below the packer is controlled by a safety valve which is adapted to be moved from normally closed to open position by means of control fluid supplied to the valve through a line leading from a remote surface. In one of its aspects, this invention relates to improvements in the arrangement and operation of the safety valve, and, in another aspect, to improvements in the manner in which the packer is set.

There are many instances in which an operator desires to circulate fluid from the annulus above the packer to the annulus therebelow. For example, he may wish to inject gas through the annulus and into the tubing string below the packer in order to stimulate production through the tubing. Alternatively, there may be instances in which the operator wishes to circulate from below the packer to above the packer, or in which he merely wishes to establish communication therebetween regardless of which pressure is predominant—e.g., to monitor pressure within the annulus below the packer. In any event, as in the case of the tubing safety valve disclosed in my copending application, Ser. No. 168,435, filed July 10, 1980, and entitled "Flow Controlling Apparatus", now U.S. Pat. No. 4,325,431 issued Apr. 20, 1982 the valve for controlling the circulation of the fluid must be capable of automatically closing, or remaining closed, in the event the supply of control fluid is lost, as by destruction of the line through which it is supplied.

As in the case of tubing safety valves, prior safety valves for controlling flow within the annulus above and below the packer have been either tubing mounted or wireline retrievable. As pointed out in my copending application, tubing mounted valves are often preferred since, when open, they leave a full opening through the tubing to permit wireline operations below the valve. However, since the valve is mounted in the tubing string, its pressure responsive operating parts, and especially dynamic seals, may not be retrieved for replacement or repair without pulling the tubing string. On the other hand, although wireline retrievable valves permit the valve and its operating parts to be retrieved, they nevertheless restrict the bore of the tubing so that they must be removed to permit wireline operations below the valve.

It is therefore an object of this invention to provide apparatus of this type having an annulus safety valve which provides the advantages of both tubing mounted and wireline retrievable annulus safety valves, without the disadvantages of either, in that it enables a full opening through the tubing while, at the same time, permitting at least some and preferably all of the parts of the valve to be retrieved and repaired or replaced without pulling the entire tubing string.

This and other objects are accomplished, in accordance with the illustrated embodiment of the present invention, by apparatus of the type described in which the body means which is connected as part of the tubing string and packed off within the well bore has a pocket to one side of the bore therethrough and opening to the bore, and a tool carrying fluid responsive means for moving the annulus safety valve from a position normally closing the flow path to a position opening the flow path is adapted to be moved vertically through the tubing string into and out of landed position within the pocket, whereby control fluid for so moving the valve may be supplied, when the tool is so landed, through a line leading from a remote source, such as the head of the well. Thus, as in the case of the tubing safety valve disclosed in my copending patent application, the annulus safety valve of the present invention does not restrict the bore through the body means, or the tubing string in which it is connected, and, at the same time, permits at least the operating parts of the annulus safety valve to be retrieved for purposes of replacement or repair. In the preferred embodiment of the invention, the valve means as well as the fluid pressure responsive means for moving it are carried by and thus retrievable with the tool.

As illustrated, the body means includes a tubing hanger about which the packer is disposed, and a mandrel in which the pocket is formed, the mandrel being releasably connected to the tubing hanger, and the mandrel and tubing hanger having bores therethrough which are aligned with one another as well as the tubing string, and openings which connect to form the passageway through the body means when the mandrel and tubing hanger are releasably connected.

As also noted in my copending application, side pocket mandrels have ordinarily been formed of a pair of side-by-side tubular members, one of which has a main bore formed therein and the other of which has the pocket formed therein. The side of the member in which the bore is formed is normally slotted along a mid portion of its length to receive one side of the other tubular member, and, when so assembled, the members are welded to one another. However, it may be desirable to form the tubing of a steel whose crystaline structure may be upset by welding. Also, welding of the tubular members may distort them to such an extent that they are misaligned—e.g., the axis of the through bore and pocket are not substantially parallel. In some applications, such as the safety valve above described, this substantial axial misalignment could interfere with the necessary cooperation between parts movable along the axes of the bore and pocket.

It is therefore another object of this invention to provide apparatus of the type described wherein the mandrel in which at least parts for operating the annulus safety valve are received doee not require welding.

For this latter purpose, the mandrel has a portion above the packer whose outer cylindrical diameter is eccentric of the axis of its bore so as to provide a thickened wall to one side of the bore, and at least the pressure chamber and piston which reciprocates in it and is connected to the valve for operating it are disposed within the thickened wall of the mandrel. Preferably, the valve itself, and, more particularly, the above-described pocket to receive a tool carrying the valve and its operating parts, are disposed in the thickened wall, or the pocket therein, whereby, as previously described, the tubing string is unobstructed and, in the preferred embodiment, at least some if not all of the parts of the valve are retrievable for replacement or repair.

There are some applications in which it would be desirable to circulate a greater quantity of fluid through the passageway than the safety valve is capable of passing. However, a safety valve, including its control fluid responsive operating parts, are of such size as to accommodate this amount of flow would consume a large amount of precious space. Alternatively, it would be extremely expensive to duplicate the safety valve, especially since this large volume of flow is not always required. It is therefore another object to provide apparatus of the type described which is capable of circulating a large volume of fluid from the annulus above to the annulus below the pocket without increasing the size and capacity of the annulus safety valve, or duplicating it, but which at the same time maintains the "safety" feature of the apparatus in that it prevents back flow from the annulus beneath the packer to the annulus above the packer.

Thus, in accordance with another novel aspect of the present invention, a check valve is provided to close a second flow path of the means in the body means which bypasses the packer to connect the annulus above and below the packer, except when the pressure of fluid in the annulus above the packer exceeds that in the annulus below the packer by a predetermined amount. Consequently, the check valve provides a simple and inexpensive means through which more fluid may be circulated, from above to below the packer, while maintaining the basic function of the annulus safety valve in normally closing the connecting means against back flow from below the packer. Preferably, the check valve is carried by the same tool as the safety valve so that it may be run into and retrieved from the mandrel pocket without an extra wire line trip.

My copending application, Ser. No. 233,627, filed Feb. 17, 1981 and entitled, "Well Packers and Slip Assemblies for Use Therewith", now U.S. Pat. No. 4,393,929, discloses a packer in which a packing element is carried about a body means which includes a tubular member connected as part of the tubing string and a sleeve which surrounds the tubular member, the packing element being expanded into engagement with the well bore to close off the annulus about the tubing string in response to axial movement of the sleeve with respect to the tubular member. A pressure chamber formed within the body means includes a piston on the sleeve, and the tubular member has a port therein which connects the bore of the tubing string with the chamber so that, upon plugging of the tubing string beneath the port, tubing pressure acts over the piston to urge the sleeve in the one direction to expand the packing element.

As it is run into the well bore with the tubing string, the packing element is in a normally contracted position and the sleeve is locked with respect to the tubular member so as to prevent it from moving in a direction to expand the packing element. In the packer of my copending application, Ser. No. 253,627 filed Feb. 17, 1981, and entitled, "Well Packers and Slip Assemblies for Use Therewith", now U.S. Pat. No. 4,393,929, as well as in other packers of this general type, such as those shown in U.S. Pat. Nos. 3,112,796 and 3,189,095, the means for locking the sleeve to the tubular member is released in response to tubing pressure, which, upon such release, then moves the sleeve in a packing element expanding direction. As a result, it is not possible to pressure up the tubing string, so as to test it or for other purposes, without setting the packer, which would be undesirable if, for example, the test showed the tubing to be faulty.

Although the locking means could be released without setting the packer if the releasing mechanism were made responsive to a source of pressure other than tubing, as, for example, a remote source conducted downwardly through a control line within the annulus, extreme expense would be involved in running a separate control line to it for this purpose. On the other hand, it would ordinarily be risky to operate the releasing mechanism by means of control fluid adapted to be used for additional purposes, such as controlling a safety valve. Thus, the control fluid could be lost, and the other control functions dependent on it could fail, in the event of leakage past one or more of the dynamic seals of the pressure responsive mechanism.

It is therefore an object of this invention to provide a packer of this type in which the tubing string may be pressured up, without releasing the packer to be set, but in which a mechanism for then releasing the packer to be set may be operated by control fluid usable for other downhole purposes, such as controlling an annulus safety valve, without the above-described risks.

This and other objects are accomplished, in accordance with the illustrated embodiment of the invention, by a packer having means for releasing the packing element expanding means which is responsive to control fluid supplied thereto through the passageway which by-passes the packer. Prior to installation of the above-described tool carrying the annulus safety valve within the pocket of the body means from which the passageway extends, another tool is installed therein to connect the control line leading to the pocket with the passageway, whereby control fluid may be supplied to the means for releasing the packing element expanding means. As illustrated, this releasing means includes a piston which is disposable within the passageway to close it when in such holding position. Consequently, upon lowering of the tubing string, the operator may pressure it up to test it, or for other purposes, and then cause control fluid at a desired pressure to be supplied through the control line into the passageway in order to move the piston to a position for releasing the locking means. The packing element expanding means may then be actuated by tubing pressure to expand the packing element, the piston moving out of the passageway, as the packer is set, so as to open it in order to connect the annulus in the well bore above and below the packing element. The above-described tool may then be removed and replaced in the pocket of the body means by the tool which carries the annulus safety valve, thereby establishing control over circulation through the passageway, as above described.

As will be understood from the foregoing, when the tool carrying the safety valve is installed in the pocket, control fluid is sealed off from the passageway so that the operator need not be concerned with the risk of losing control over circulation through the passageway, or other functions to be performed in response to the control fluid, due to leakage of the pressure responsive means for releasing the packing element expanding means.

In the drawings, wherein like reference characters are used throughout to designate like parts:

FIG. 1A is a vertically interrupted, longitudinal sectional view of apparatus constructed in accordance with this invention including body means connected as part of a tubing string suspended within and adapted to be packed off within a well bore, and wherein the annulus about the string above and below the packer is connected by means including a passageway in the body means which bypasses the packer when set, a tool being installed within a pocket of the body means to one side of the bore therethrough in order to connect a control line with the passageway so that control fluid may be supplied to a means adapted to release a locking mechanism locking the packer in its unset position;

FIG. 1B is a view similar to FIG. 1A, but with the tool of FIG. 1A removed from the pocket and replaced by another tool carrying a safety valve which is adapted to control flow through the passageway and between the annulus above and below the packer in that it may be moved from a normally closed to an open position in response to the supply of control fluid to the operating means of the valve through the control line;

FIGS. 2A, 2B, and 2C are enlarged, vertical sectional views of upper, intermediate and lower portions, respectively, of the pocket formed in a thickened wall of the mandrel, as seen along broken lines 2B–2C of FIG. 7, and with the connecting tool shown in FIG. 1A installed therein;

FIGS. 3, 4, 5, 6 and 7 are reduced, cross-sectional views of the mandrel, with the connecting tool removed therefrom, and taken along broken lines 3—3, 4—4, 5—5, 6—6 and 7—7 of FIGS. 2A, 2B and 2C;

Figure 8A:
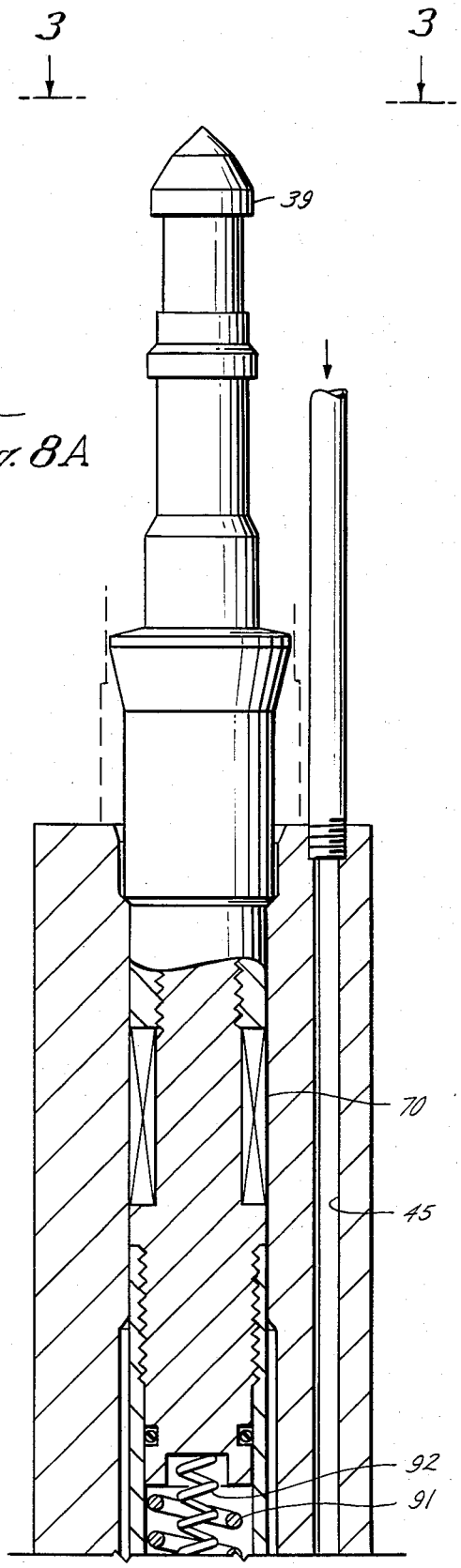
FIGS. 8A, 8B and 8C are vertical sectional views of the mandrel, similar to FIGS. 2A, 2B and 2C, but with the connecting tool removed therefrom and replaced by the tool shown in FIG. 1B which carries the safety valve for controlling circulation through the passageway.
Figure 8B:
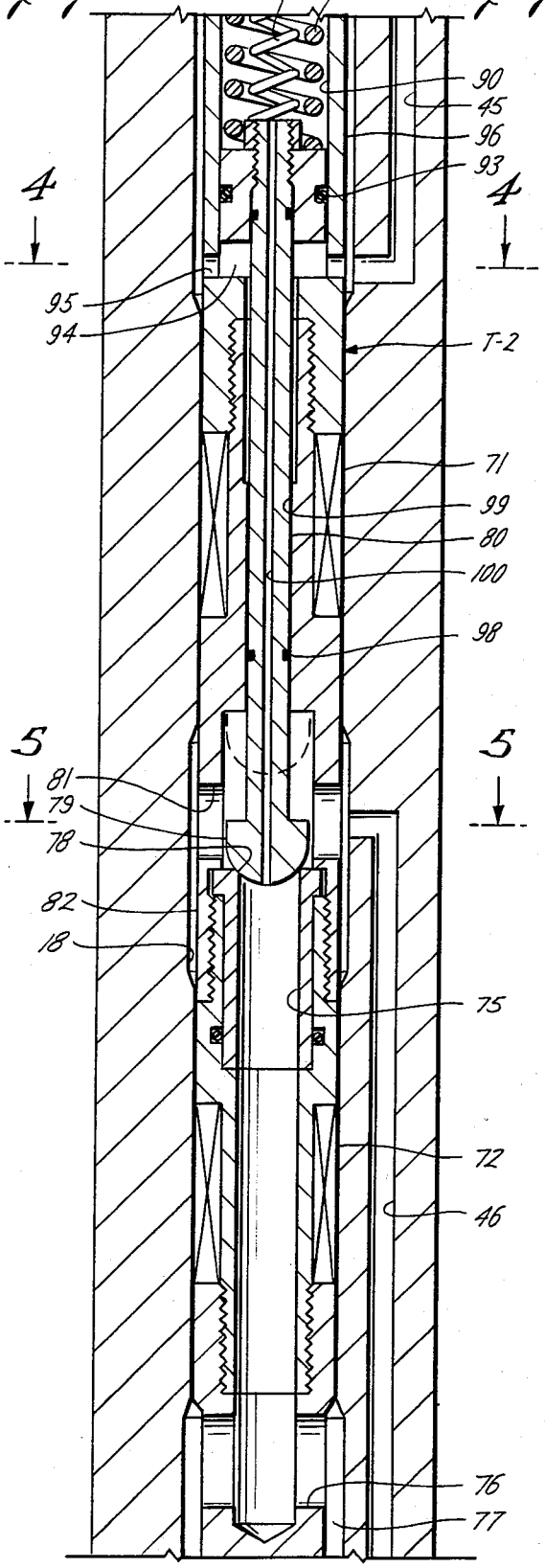
Figure 8C:
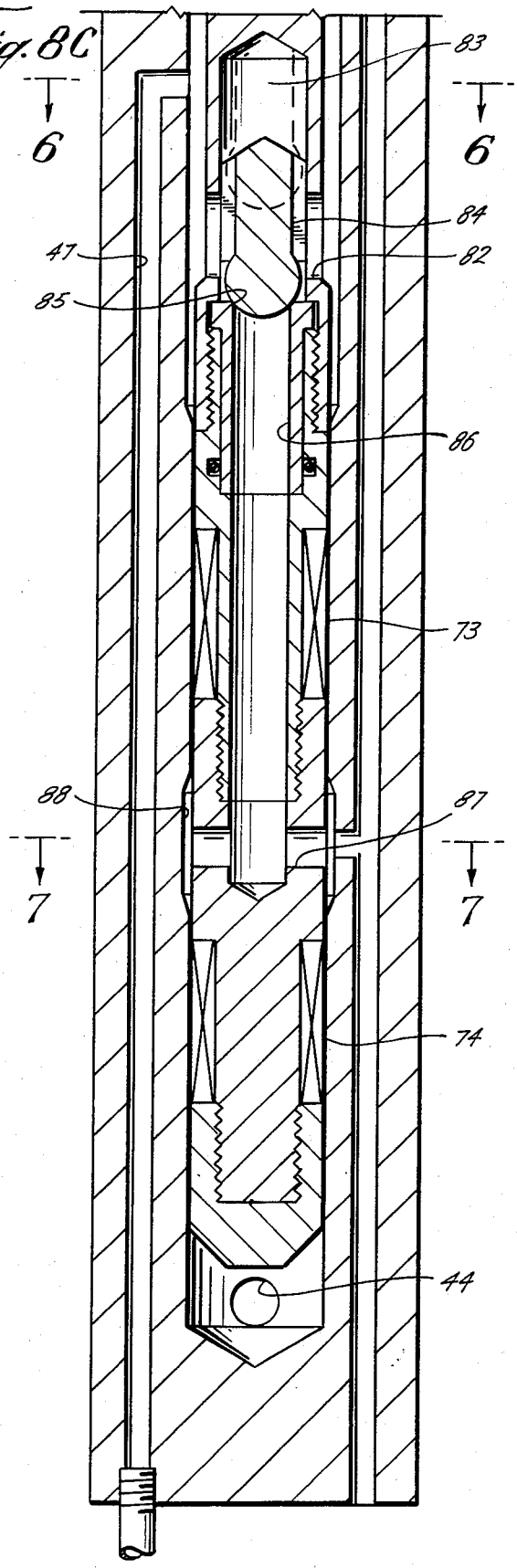
Figure 9A:
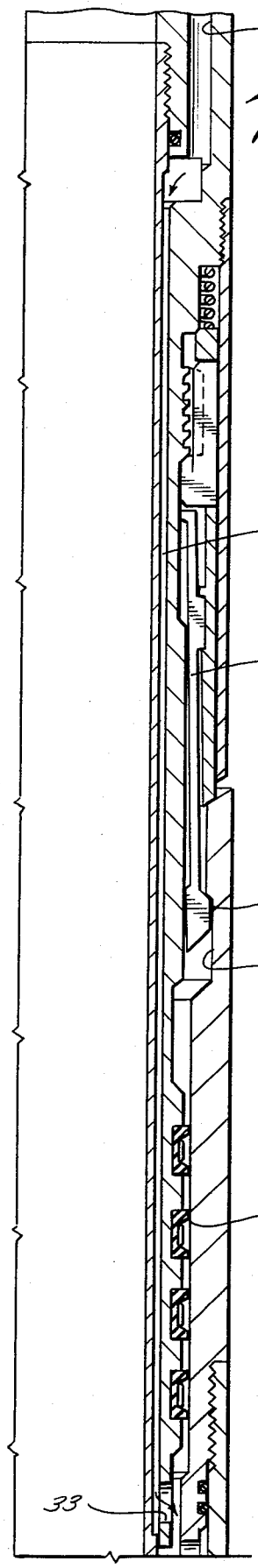
FIGS. 9A, 9B, 9C and 9D are enlarged vertical sectional views of the lower portion of one side of the body means shown in FIGS. 1A and 1B, including the tubing hanger about which the packing element is carried, and with the packing element shown in the contracted position of FIG. 1B.
Figure 9B:
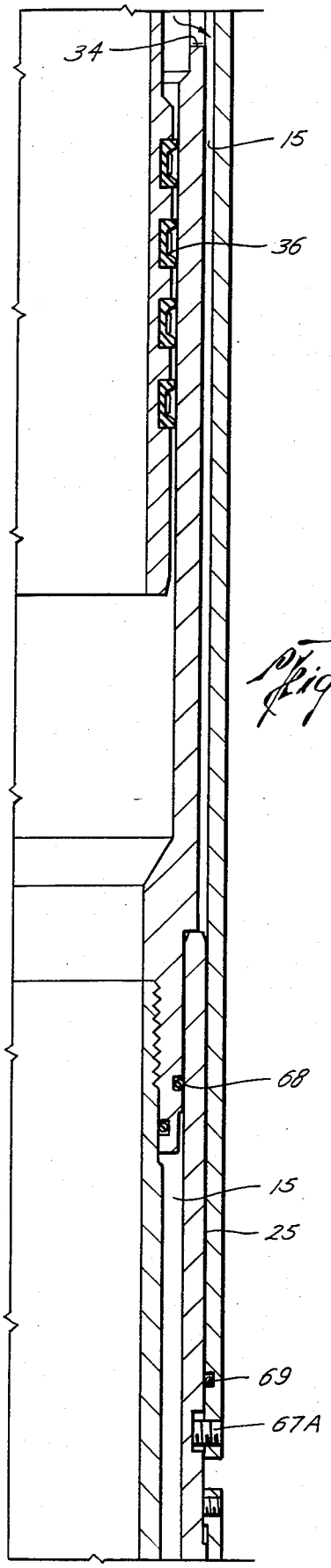
Figure 9C:
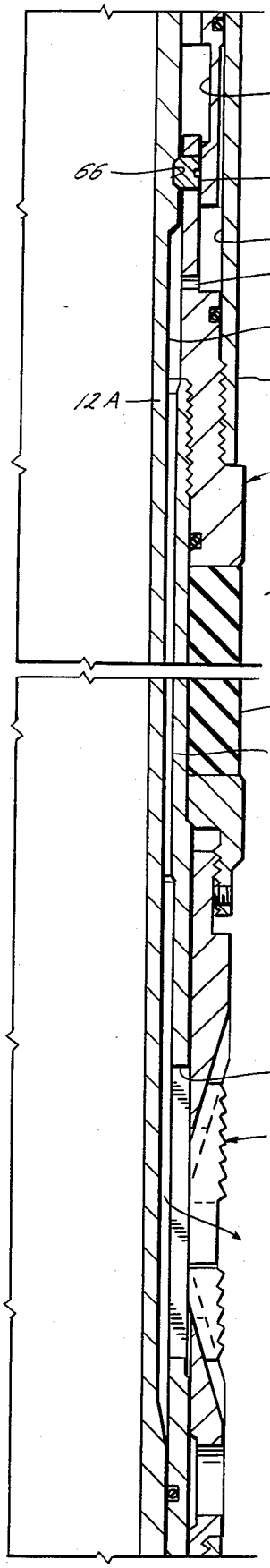
Figure 11:
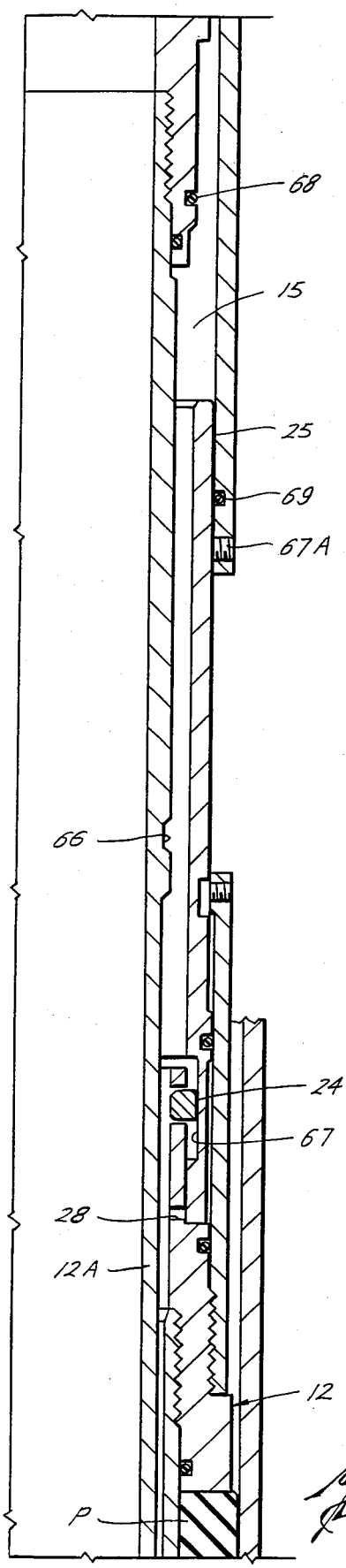
Figure 10:
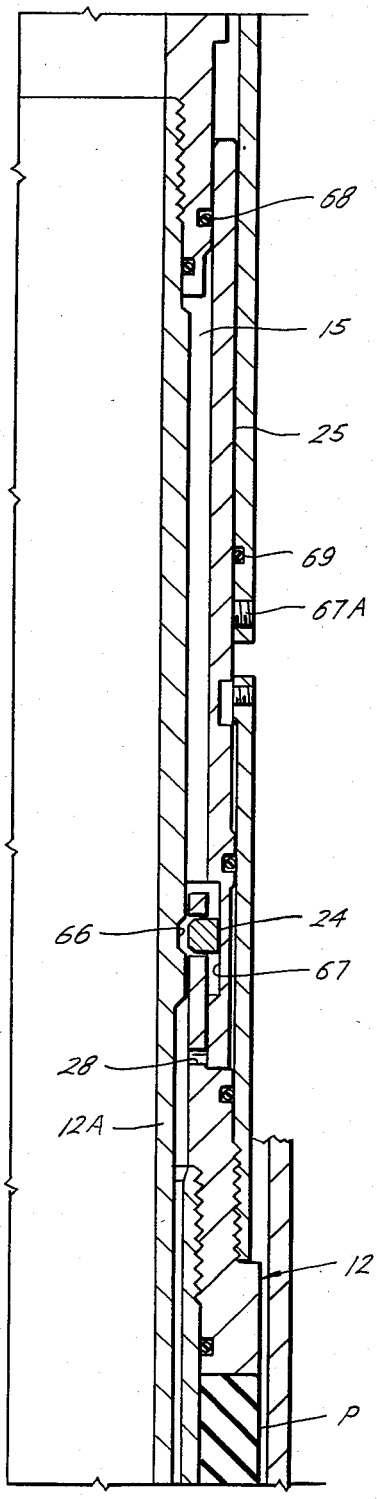

FIG. 10 is a vertical sectional view of an intermediate portion of the one side of the body means, as shown in FIGS. 9B and 9C, but upon lowering of a piston within the passageway, in response to the supply of control fluid thereto, so as to move the sleeve which depends from the packer from the locking means holding position of FIGS. 8B and 8C to a position in which the locking means is released; and FIG. 11 is a vertical sectional view of a portion of the body means, similar to FIG. 10, but upon expansion of the packing element to set the packer and movement of the piston out of the passageway to open it and thereby establish circulation between the annulus above and below the packing element.

Figure 1A:
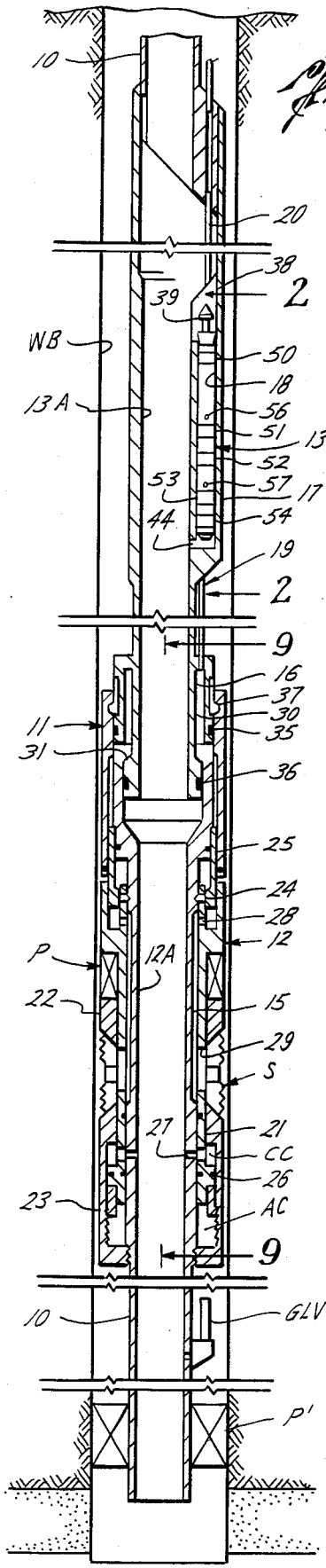
Figure 1B:
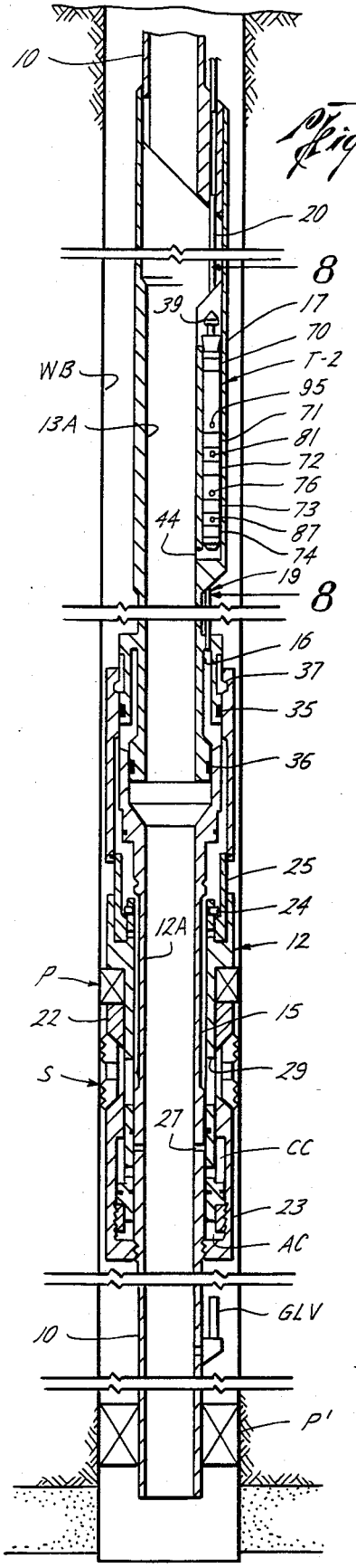

With reference now to the details of the above-described drawings, FIGS. 1A and 1B show a tubing string 10 suspended within a well bore WB which penetrates a production zone Z at its lower end. A body means 11 which is connected as a part of the tubing string includes a tubing hanger 12 from which a lower portion of the tubing string is suspended, and a mandrel 13 suspended from the lower end of an upper portion of the tubing string and releasably connected to the tubing hanger, with bores 12A and 13A in the tubing hanger and mandrel, respectively, in axial alignment with one another and with the tubing string.

A packing element P is carried by the tubing hanger 12 for sealing engagement with the well bore, and a slip assembly S is also carried by the hanger beneath the packing element for gripping engagement with the well bore. As shown, the tubing is packed off within an open hole, although it will be understood that the well bore may instead be lined with casing. In any event, production from the zone Z flow upwardly through the lower end of the tubing string 10 to the wellhead (not shown). The annulus about the tubing string above and below packer P is connected by means which includes an annular passageway in the body means comprising aligned annular openings or passageway 15 and 16 through the tubing hanger 12 and mandrel 13, respectively.

The mandrel includes a portion 17 above packer P having an outer cylindrical surface which is eccentric to the axis of the mandrel bore, and thus to the tubing string, to provide a thickened wall on one side of the bore 13A thereof. A pocket 18 is formed in the thickened wall and has an open upper end which connects with the bore, and a tube 19 connects the upper end of annular opening 16 in the mandrel to the pocket 18 of the mandrel, in a manner to be described hereinafter. Each of a connecting tool T-1 and a control tool T-2 carrying an annulus safety valve may be removably installed in the pocket 18, when the other is removed therefrom, by means of a suitable running tool (not shown) which raises and lowers it through the tubing string into and out of landed position within the pocket.

A line 20 extends within the annulus to connect a source of control fluid at the wellhead or other remote location with the pocket 18, and, as will be described in detail to follow, the pocket is also connected with the annulus about the mandrel above the packer. As previously described, when tool T-1 is installed in the pocket, as shown in FIG. 1A, it connects the control line 20 with the line 19 leading to the annular passageway within the body means. When tool T-1 is removed from the pocket, tool T-2 may be installed therein, as shown in FIG. 1B, to disconnect the control line from the annular passageway, and instead provide a flow path to connect the annulus above the packer with the line 19 so as to establish circulation within the annulus above and below the packer. More particularly, tool T-2 carries safety valve means which normally closes the flow path, but which is adapted to open in order to permit circulation therethrough in response to control fluid supplied through the control line 20 to an operating means for the valve within the tool T-2.

As also previously mentioned, and as will be described to follow, the means which by-passes the packer to connect the annulus above and below the packer includes a second flow path, and a check valve is arranged in the tool T-2, as to open and close the second flow path and thereby further control the circulation of an additional volume of fluid between the annulus above and below packer P, in the sense of preventing flow from below the packer to above the packer, but preventing flow from in the opposite direction, regardless of the supply or non-supply of control fluid. For this purpose, the first and second flow paths are arranged in parallel so that, when installed in the pocket, tool T-2 also connects the check valve to the tube 19 and the annulus above the packer, and thus is in position to control flow therethrough, as described.

In the illustrated well installation of FIGS. 1A and 1B, the apparatus of the present invention may be used to inject gas downwardly through the annulus into the tubing string beneath packer P for stimulating production from zone Z. For this purpose, the lower portion of the tubing string is packed off by a lower packer p' intermediate the packer P and the zone Z, and gas lift valves, such as the gas lift valve GLV, are installed in the lower portion of the tubing above the packer P'. Consequently, with tool T-2 installed in pocket 18, control fluid may be supplied through line 20 to open the safety valve carried within tool T-2 in order to permit gas to be circulated downwardly through the annulus, through the body means 11, into the annulus between packers P and P', and thence through the gas lift valves GLV into the tubing string 10. When the gas is not being so circulated, the annulus safety valve is closed to prevent flow between the annulus above and below the packer P, and, since it is "fail safe", as will be explained hereinafter, it remains closed to prevent back flow even when control fluid for operating the safety valve is lost, as by destruction of the control line. The check valve is of course complementary to this function of the safety valve in that it will open to increase the quantity of gas flowing into the annulus below the packer P, but close to prevent back flow when the injection of gas is discontinued.

As previously mentioned, and as will be described in detail to follow, tubing hanger 12 includes means for locking the mans by which the packing element P and slip assembly S are expanded into engagement with the pipe in an inoperative position, as the string is lowered into the well bore, and then pressured up, as well as a means for releasing the locking means so that the packing element and slip assembly may be expanded into the position shown in FIG. 1B. More particularly, in accordance with the novel aspects of this invention, while the packing element and slip assembly are caused to expand in response to tubing pressure, the means by which the locking means is released is responsive to control line pressure, so that the tubing may be pressured up without setting the packer.

Except for the means by which the locking means is released, and the bypass passageway therein, the tubing hanger 12 and packer carried thereby are very similar to those disclosed in my aforementioned copending application, Ser. No. 233,627, filed Feb. 17, 1981, and entitled "Well Packers and Slip Assemblies for Use Therewith" now U.S. Pat. No. 4,393,929. Thus, as shown diagrammatically in FIGS. 1A and 1B, the tubing hanger includes a tubular member 21 forming the lower portion of the bore 12A through the body means, and a pair of sleeves 22 and 23 which surround the tubular member for axial movement with respect thereto as well as with respect to one another between the axially expanded position of FIG. 1A and the axially retracted position of FIG. 1B. The packing element P as well as the slip assembly S are carried about the sleeve 22 and vertically intermediate a downwardly facing shoulder on the sleeve 22 and an upwardly facing shoulder on the sleeve 23. Thus, in a manner disclosed in the aforementioned application Ser. No. 233,627 filed Feb. 17, 1981, and entitled "Well Packers and Slip Assemblies for Use Therewith", now U.S. Pat. No. 4,393,929, and to be described in detail to follow, relative axial movement of the sleeves from the position of FIG. 1A to the position of FIG. 1B will force the normally contracted packing element and slip assembly radially outwardly into engagement with the well bore WB.

In their expanded position, sleeve 23 is held down against upward movement with respect to tubular member 11A, and the sleeve 22 is releasably locked to the tubular member by means of locking parts 24 carried by the upper end of the sleeve for movement into and out of locking engagement with a groove about the tubular member. Another sleeve 25 which is carried about the tubular member for axial movement with respect to it, as well as with respect to sleeve 22, has a lower end which, in the upper position of the sleeve 25, surrounds locking parts 24 to hold them in locking engagement. However, upon lowering of the sleeve 25 from the position of FIG. 1A to the position of FIG. 1B, an intermediate recessed portion on the inner diameter of the sleeve 25 permits the locking parts 24 to be moved outwardly out of locking engagement with the tubular member, whereby sleeve 22 may be moved downwardly with respect to sleeve 23 so as to expand the packing element and slip assembly, as previously described.

A piston 26 on the sleeve 22 is slidable within an annular space between the tubular member and the sleeve 23 to form an atmospheric chamber AC beneath it. More particularly, the portion of the sleeve 22 above piston 26 is sealably slidable with respect to both the tubular member and the sleeve 23 so as to form a control chamber CC above piston 26, which is connected to the bore of the tubing by means of a port 27 in the tubing member. As will be better understood from the description to follow, and as is well known in the art, the atmospheric chamber AC enables ambient well fluid to urge the sleeve 22 downwardly to the retracted position of FIG. 1B when it is unlocked from the tubular member. Also, of course, tubing pressure may be supplied through the port 27 to the control chamber CC for moving the sleeve 22 to its fully retracted position. As the sleeves move relatively toward retracted position, they are locked against return movement to extended positions by locking means, such as ratchet teeth on their adjacent surfaces, as indicated diagrammatically in FIGS. 1A and 1B, and as will be described in detail to follow.

As shown in FIG. 1A, when the sleeve 25 is in its upper position for holding the locking means 24 in locking position, an annular piston on its upper end is disposed in the portion of the annular opening 15 formed within the upper extension of the tubular member so as to close the passageway in the body means. With tool T-1 installed in the pocket 18, as shown in FIG. 1A, pressure fluid may be supplied downwardly through the passageway so as to act over the piston and thus urge sleeve 25 in a downward direction to the releasing position of FIG. 1B. It will be understood, however, that before such pressure is supplied through the control line, the tubing may have been tested, or pressured up for other purposes. In any event, with the sleeve 22 unlocked, well fluid is effective to urge it downwardly to retracted position.

When sleeve 25 is lowered to release the locking means 24, the piston on its upper end is still within the annular opening in the upward extension of the tubular member. However, the piston moves out of this opening as the sleeve 22 moves downwardly to packer expanding position. This may occur either in response to the force of control fluid acting on the piston, or due to engagement of sleeve 22 with sleeve 25, or both. In this respect, the sleeve is lowered into engagement with the lower end of an annular recess in sleeve 22, and it may be found that the force due to control fluid will assist in lowering the sleeve. A port 28 is formed in the sleeve 22 to vent the annular space to the passageway between the tubular member 11A and the sleeve 22, and thereby prevent a fluid lock. Large openings 29 are formed in the sleeve 22 opposite the slip assembly S so as to connect the lower end of the opening 15 between the sleeve 22 and the tubular member with the exterior of the tubing hanger beneath the packing element P.

The means by which the lower end of mandrel 13 is releasably locked to the upper end of tubing hanger 12 is similar to that disclosed in my copending application, filed Jan. 15, 1981 Ser. No. 225,395 now U.S. Pat. No. 4,477,104, and entitled "Releasable Latching Apparatus", except of course for the formation of the annular opening therein which connects with the upper end of the annular opening in the tubular hanger to form the passageway in the body means. Thus, reference may be had to such copending application for details of the locking mechanism, and, for that matter, to other more conventional locking mechanisms such as those mentioned in such application. In any event, and as shown diagrammatically in FIGS. 1A and 1B, and in detail in FIG. 9A, the mandrel includes inner and outer tubular members 30 and 31 which are spaced apart to form the annular opening 16 which connects at its upper end with a port 32 leading to the lower end of tube 19 and at its lower end with ports 33 leading to the outside of the mandrel, and thus to ports 34 into the upper end of the annular opening 15 formed in the tubing hanger extension. More particularly, seal means 35 are carried about the enlarged lower end of tubular member 30 for sealing with respect to the enlarged inner diameter of the upper end of the tubing hanger above ports 33 and 34, and seal means 36 are carried by the outer tubular member 31 of the mandrel for sealably engaging the somewhat reduced inner diameter of a lower portion of the tubing hanger below such ports. As described fully in the aforementioned pending application, locking parts 37 are carried by the mandrel outside of the passageway for releasably fitting within a locking groove 37A about the inner diameter of the tubing hanger extension.

Ordinarily, a tubing safety valve would be installed in the tubing string 10 above the upper portion thereof. Preferably, this tubing safety valve would be of a construction and operation disclosed in my aforementioned copending application, Ser. No. 168,435, filed July 10, 1980, entitled "Flow Controlling Apparatus" now U.S. Pat. No. 4,235,143. In this event, the control line 20 would be a downward continuation of the control line shown in the aforementioned prior application for use in controlling the tubing safety valve.

As in the case of the tubing safety valve of my U.S. Pat. No. 4,235,431, and as shown in FIGS. 3 to 7, the eccentric mandrel portion 17 is preferably made up of inner and outer bodies 17A and 17B, with the outer body being tubular and the inner body having an eccentric bore therethrough and the pocket 18 formed within the thickened wall thereof. As explained more fully in my U.S. Pat. No. 4,235,431, this construction of the mandrel avoids the necessity for welding together of two bodies forming the bore and the pocket.

As shown diagrammatically in FIGS. 1A and 1B, guide parts 38 are mounted on the inside of the outer mandrel body above the open upper end of the pocket 18 so as to guide the tools T-1 and T-2 into and out of landed position within the pocket. The tool has a neck 39 about its upper end to receive a suitable running tool, as well as a shoulder 40 beneath the neck for landing upon a seat 41 in the upper end of the pocket to locate the tool against further downward movement (see FIGS. 2A and 8A). Although, as will be described, the tool is pressured balanced with respect to tubing pressure acting upon its upper and lower ends, it has radial enlargements in the form of locking dogs 42 above the landing shoulder which, in the event it is accidentally caused to move upwardly, are restrained by means of a downwardly facing shoulder 43 within a groove about a suitable nipple (see broken lines) above the mandrel pocket.

The lower end of mandrel pocket 18 is connected with the bore 12A through the mandrel by means of one or more ports 44. This not only prevents a fluid lock as seals about the tool T moved slidably down into the pocket, but also pressure balances the tool in that tubing pressure acts over equal effective sealing areas on opposite ends of the tool, when landed, as will be understood from the description to follow.

Figure 2A:
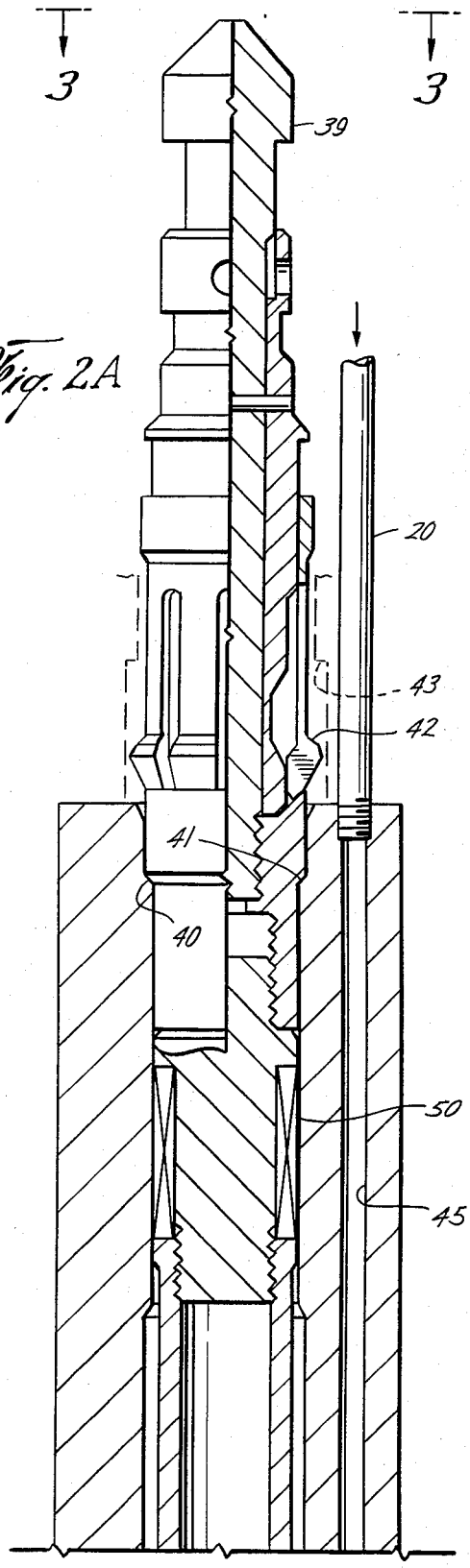
Figure 3:
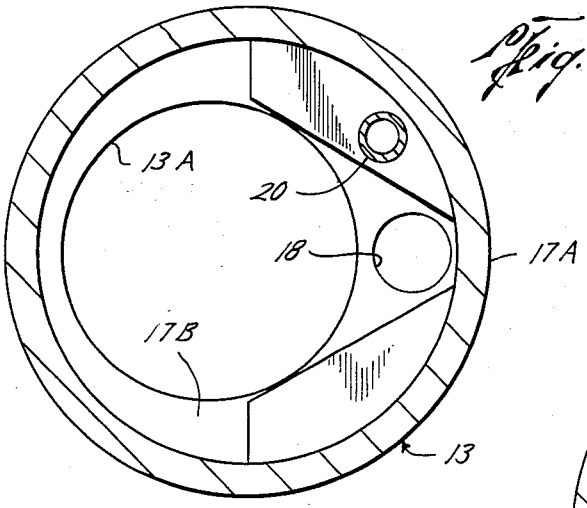
Figure 4:
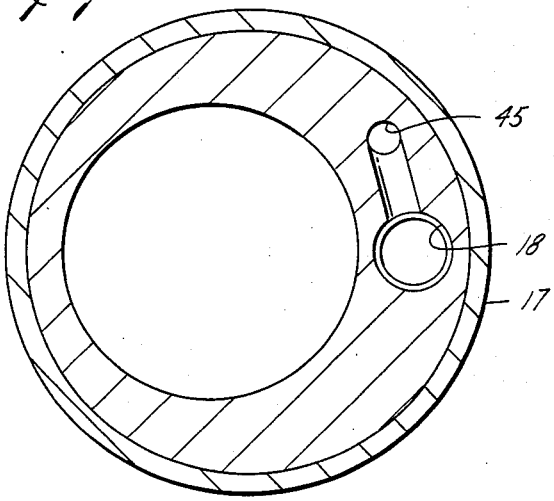
Figure 6:
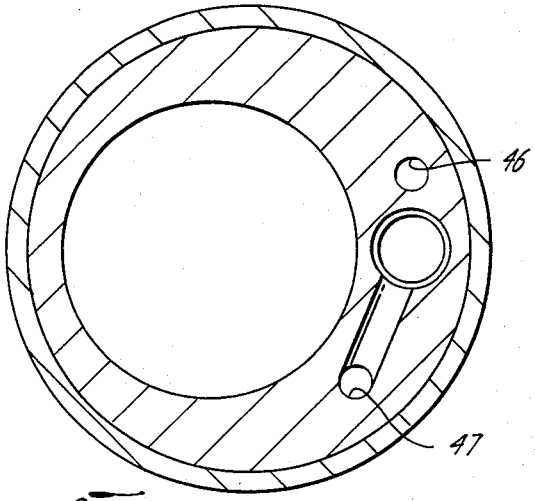
Figure 5:
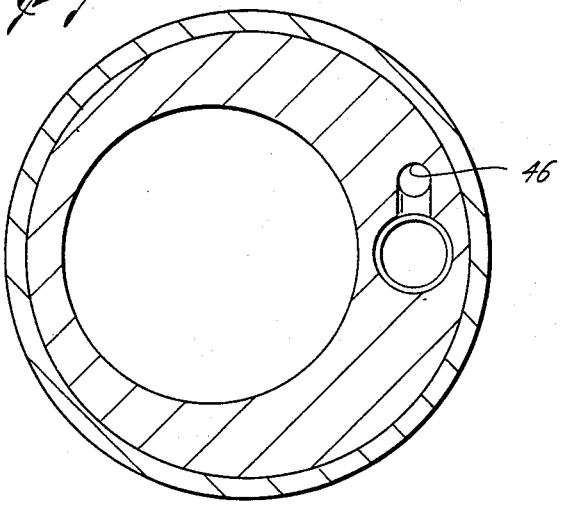
Figure 7:
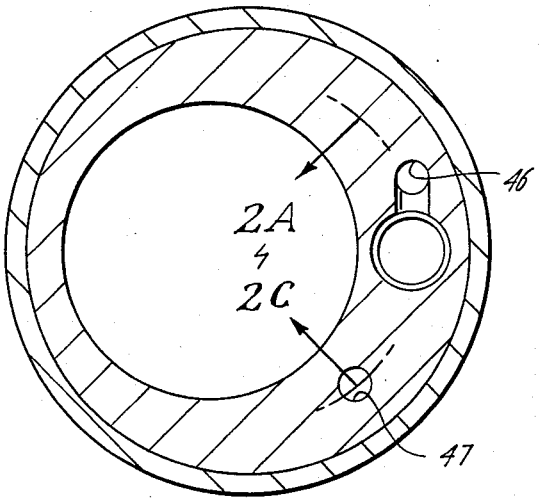

As shown in FIGS. 2A and 8A, the control line 20 connects with a passageway 45 which extends downwardly through the upper end of the thickened wall of the mandrel to one side of the pocket 18, as best shown in FIG. 3. The tube 19 which connects with the annular passageway through the lower end of the mandrel and the tubing hanger is connected to the lower end of another passageway 47 in the thickened wall of the mandrel which, as shown in FIGS. 5, 6 and 7, is on the side of the pocket 18 opposite the passageway 45. A further passageway 46 having a lower end open to the annulus A above the packer P extends upwardly within the thickened wall of the mandrel on the same side of the pocket 18 as the passageway 45, and thus, as will be understood from FIGS. 6 and 7, on the side of the pocket opposite the passageway 47 leading to the annulus below the packer.

The lower end of passageway 45 extends laterally to intersect the pocket 18 at a level above the intersection of the lateral extent of the upper end of passageway 46 intersecting with the pocket. Thus, there is no vertical overalpping of the passageways 45 and 46 which might weaken the metal separating them. The lateral extent of the passageway 47 interacts with the pocket 18 beneath the intersection of the upper lateral extent of passageway 46 therewith, but above the intersection of a lower lateral extent of passageway 46 with the pocket.

Figures 2B, 2C:
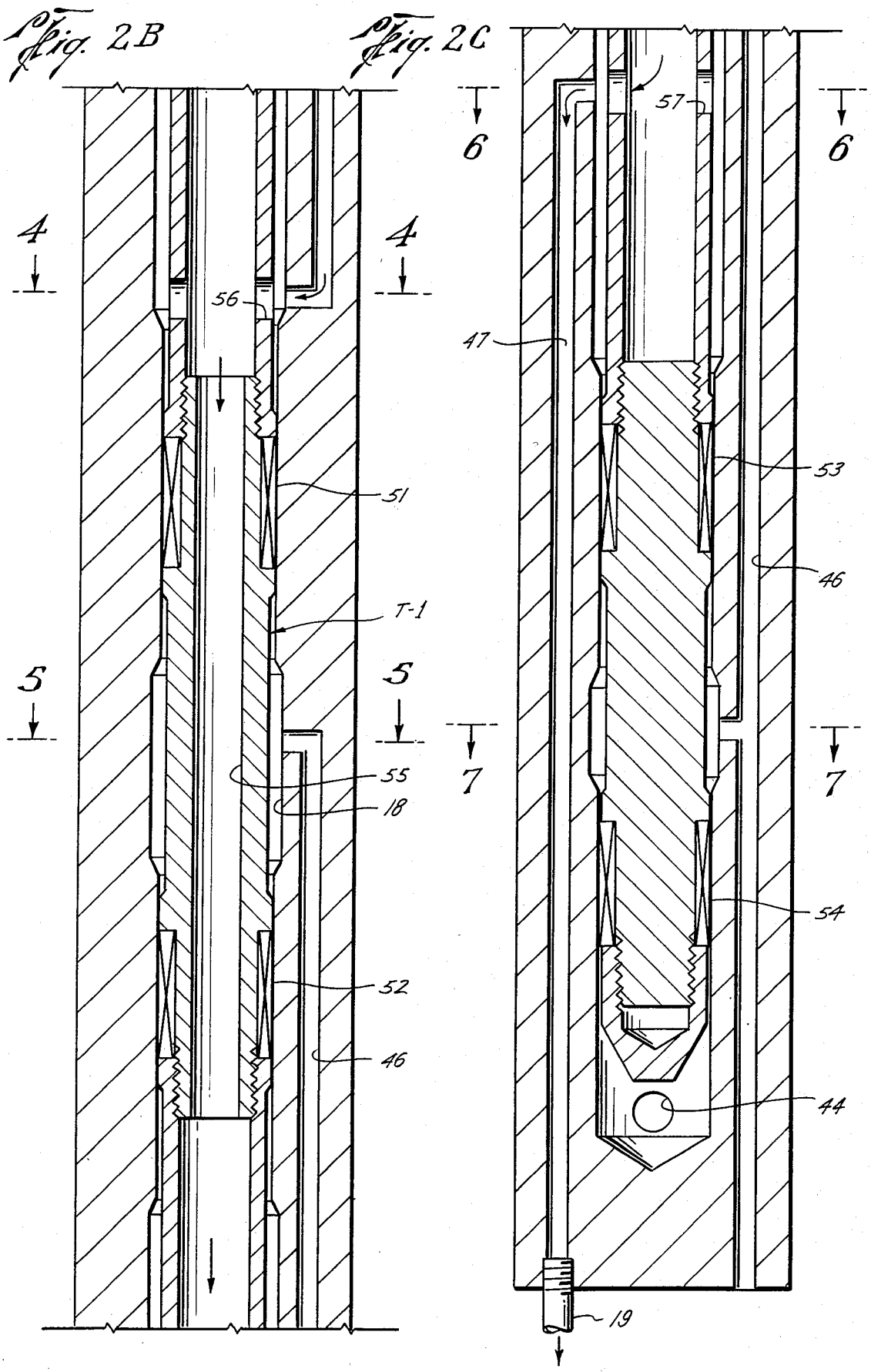

As shown in FIGS. 2A, 2B and 2C, the body of tool T-1 carries seal means 50 for sealably engaging the pocket 18 intermediate its upper end and the intersection therewith of passageway 45, as well as seal means 51 for sealably engaging the pocket beneath the intersection therewith of passageway 45. The body of tool T-1 further carries seal means 52 which sealably engages the pocket beneath the intersection of the upper end of passageway 46 and the intersection of the upper end of the passageway 47 therewith. Further seal means 53 are carried about the body of tool T-1 for sealably engaging the pocket intermediate the intersection of passageway 47 and the intermediate section of passageway 46 therewith, and a lowermost seal means 54 is carried thereabout for sealably engaging the pocket between the intermediate intersection of passageway 46 therewith and the port 44.

The main portion of the tool body is hollow to form a longitudinal passageway 55 which is closed at its upper end and connected by ports 56 with the annular space between the tool body and the pocket above seal means 51, and thus with the intersection of passageway 45 with the pocket. The tool body is also provided with ports 57 above its lower closed end for connecting with the annular space between the tool body and the pocket intermediate seal means 52 and 53, and thus with the intersection with the pocket of passageway 47. Thus, it will be obvious, that with the tool T-1 landed within the pocket 18, the control line is connected through the passageways 45 and 47 in the mandrel and the passageway 55 in the tool body to the annular passageway within the body means leading to the pressure responsive releasing mechanism of the packer.

Inasmuch as the packer 12 may be of a construction similar to that in my copending application Ser. No. 233,627 filed Feb. 17, 1981, and entitled "Well Packers and Slip Assemblies for Use Therewith", now U.S. Pat. No. 4,393,929, except insofar as the releasing mechanism is concerned, or, for that matter, may be constructed in accordance with other packers of this general type, a very detailed description of the packer, in addition to the prior general description thereof in connection with FIGS. 1A and 1B, is believed unnecessary. Thus, in summary, the sleeve 23 of the packer is disposed about the lower end of the sleeve 22 as well as about the tubular member so as to form an annular space between it and the tubular member beneath the lower end of the sleeve 22. In addition, the packing P and slip assembly S are carried about the sleeve 22 intermediate a downwardly facing shoulder on the sleeve 22 and an upwardly facing shoulder on the sleeve 23. More particularly, and as shown in FIG. 3C, the sleeve 23 is made up of separate upper and lower parts each having expander surfaces thereon over which expander surfaces on the slips of the slip assembly S are mounted for movement toward and away from the well bore.

The sleeve 23 is held against upward movement with respect to the tubular member by means of a ring 60 engageable with an enlarged inner diameter portion 61 at the lower end of sleeve 23, so that with the sleeve 22 locked against vertical movement with respect to the tubular member, the sleeves are maintained in an extended position as the tubing string is lowered into the well bore. Upon release of the sleeve 22 from locking engagement with the tubular member, and lowering thereof into a retracted position with respect to the sleeve 23, the sleeves are locked against movement back to extended positions by suitable means 62 such as the ratchet teeth formed on the outer surface of collet fingers on the lower end of sleeve 22 engageable with ratchet teeth on inner diameter of the opposing portion of sleeve 23. The detailed construction of the illustrated locking means is unimportant to the novel aspects of the present invention, and may, in any event, be derived from the aforementioned copending application Ser. No. 233,627 filed Feb. 17, 1981, now U.S. Pat. No. 4,393,929, dealing with a packer of this type.

Figure 9D:
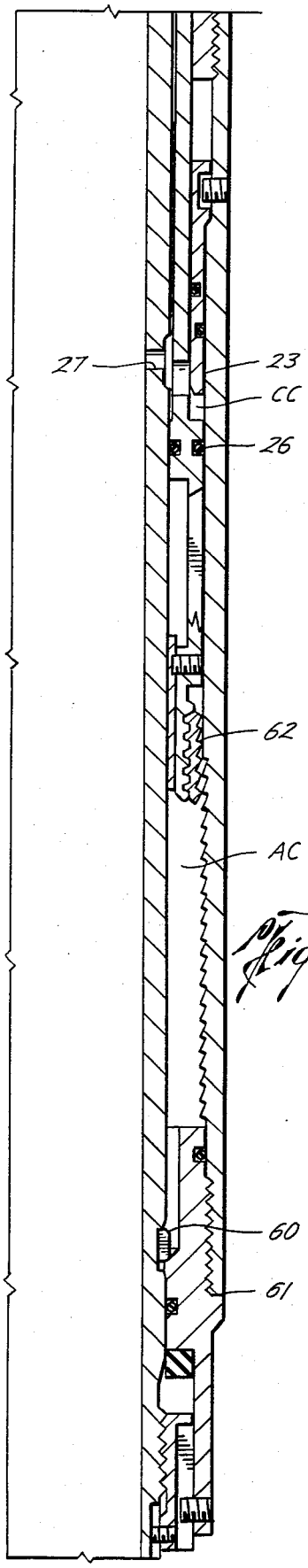

As described in connection with FIGS. 1A and 1B, and as shown in FIGS. 9C and 9D, the lower end 61 of sleeve 23 is sealed with respect to the tubular member, and a piston 26 on the sleeve 22 is slidable within the annular space above the lower end of sleeve 23 so as to form the atmospheric chamber AC in which locking means 62 is disposed. As also previously mentioned, and as well known in the art, upon release of the sleeve 22 from the tubular member, well fluid is thus effective to urge the sleeves toward retracted position. As also previously described and as shown in more detail in FIG. 9D, with the sleeves free to move to retracted position, tubing pressure may be supplied through the ports 27 through the control chamber CC above piston 26 so as to provide the force necessary to move the sleeves to fully retracted position.

As shown in FIG. 9C, the lower end of sleeve 25 fits closely within an annular space 65 of sleeve 22 so as to hold the locking means, which comprises pins 24 carried by the sleeve 22 on the inner side of space 65, within a groove 66 formed about the tubular member. An intermediate portion of the sleeve above its enlarged lower end is recessed at 67, so that when the sleeve is lowered to the position of FIG. 10, the pins 24 are free to move out of the groove 66, and thus release the locking engagement between sleeve 22 and the tubular member. The upper and lower edges of the groove, as well as the upper and lower edges of the locking pins 24 are tapered to cause them to be cammed out of the locking engagement as the sleeve 22 is moved downwardly with respect to the tubular member.

As shown in FIG. 9B, sleeve 25 is releasably connected in its upper position to the upward extension of the tubular member 11A by means of a shear screw 67A. With the sleeve so held, its inner diameter slides within a seal ring 68 with the annular opening in the tubular member, and its outer diameter slides within a seal ring 69 carried by the tubular member beneath such opening. Thus, as described, the upper end of the sleeve within the passageway acts as a piston as long as it is in sealing engagement with the upper seal ring 68, and thus in the positions of FIGS. 9B and 10.

After the tubing has been pressured up, and it is desired to set the packing, and with the tool T-1 installed in the pocket 18, control pressure may be supplied through the passageway so as to act over the upper end of the piston of sleeve 25. As a result, screws 67A are sheared and the sleeve is lowered from the postion of FIG. 9B to the position of FIG. 10 so as to permit the pins 24 to move outwardly to unlocking position with respect to the tubular member. At this time, the sleeve 22 is free to move downwardly with respect to the sleeve 23 and thereby expand the packing element and slip assembly into engagement with the well bore. As previously mentioned, control pressure may continue to urge the sleeve 25 downwardly, this force being transmitted to the sleeve 22 by engagement of the lower end of the sleeve 25 with the annular space in the sleeve 22 in which it's received. In any event, the sleeve 25 will be moved down further to the position of FIG. 11 so as to remove it from the passageway and thus open the passageway to the annulus beneath the expanded packing element. As shown, the upper end of sleeve 22 has an inner shoulder which will engage an outer shoulder near the lower end of sleeve 25 to pull it downwardly therewith, if this is required.

At this time, with the packer locked in set position, supply of control fluid to the passageway may be discontinued, the tool T-1 removed from the pocket 18 and replaced with the tool T-2 so as to establish safety valve control over circulation between the annulus above and below the packing element. As shown in FIGS. 8A, 8B and 8C, the body of tool T-2 carries seal means 70 thereabout which, with the tool landed in the pocket 18, sealably engages the pocket intermediate the upper end of the pocket and the intersection of the lateral extent of passageway 45 with the pocket. The next lower seal means 71 carried by the body of the tool sealably engages the pocket intermediate the intersection of the lateral extent of passageway 45 and the intersection of the upper lateral extent of passageway 46, while the next lower seal means 72 carried by the tool body sealably engages the pocket intermediate the intersection of the upper lateral extent of passageway 46 and the intersection therewith of the lateral extent of passageway 47. The next lower seal means 73 carried by the tool body sealably engages the pocket intermediate the intersection of the lateral extent of the passageway 47 and the intersection of the lower lateral extent of the passageway 46, while the lowermost packing means 47 carried by the tool body engages the pocket intermediate the intersection therewith of the lower lateral extent of passageway 46 and the lateral port 44 connecting with the bore of the mandrel.

A hollow intermediate portion of the tool body provides a longitudinal passageway 75 whose lower end connects through ports 76 in the tool body with an annular passageway 77 about the tool body to which the upper end of mandrel passageway 47 is connected, this latter passageway leading to the passageway through the mandrel and tubing hanger connecting with the annulus beneath the packer P. The upper end of the passageway 75 has a valve seat 78 thereabout which is normally closed by a safety valve having a closure member 79 on the lower end of the stem 80 mounted within the tool body for movement axially of the tool. When the closure member 79 is lifted from the seat 78, as shown in broken lines, it opens the passageway 75 to ports 81 in the tool body leading to an annular passageway 82 between the tool body and mandrel pocket to which the upper end of mandrel passageway 46 is connected, this latter passageway leading from the annulus A above the packer P. Thus, in this open position of the safety valve, well fluid is free to circulate from passageway 47 to passageway 46 and thus between the annulus about the tubing string above and below the packer P through a first value controlled flow path including passageway 77, ports 76, passageway 75, ports 81 and annulus 82.

The lower end of the annular passageway 77 connects through ports 82 in the tool body with a dome 83 above a check valve having closure member 84 guidably reciprocable within the dome. When the closure member 84 is lowered, it rests upon a seat 85 formed about the upper end of a passageway 86 formed by a lower hollow portion of the tool body and extending through the seal means 73 for connecting ports 87 in the tool body with an annular passageway 88 between the tool and pocket to which the lower lateral extension of passageway 46 is connected. Thus, when the closure member 84 is raised from its seat, as shown in broken lines, it also permits fluid in the annulus above the packer P to flow into the passageway 47 and thus through the passageway in the mandrel and tubing hanger into the annulus beneath the packer through a second flow path arranged in parallel to the first flow path and including ports 87, passageway 86, ports 82, and passageway 77.

Thus, as previously described, the check valve prevents flow through a second flow path in a downward direction—i.e., from the annulus below the packer to the annulus above the packer—but permits backflow therethrough in an upward direction—i.e., from the annulus above the packer to the annulus below the packer—when the pressure above the packer is greater than that below the packer. As previously mentioned, the check valve thus compliments the function of the safety valve in that it substantially increases the capacity of the safety valve to circulate fluid from the annulus above the packer to the annulus below the packer, while preventing backflow of such fluid in the opposite direction.

As shown in FIG. 8B, the stem 80 for raising and lowering the closure member 79 between its closed position and its open position extends upwardly into a cylindrical chamber 90 formed in the tool body toward its upper end. The stem is urged downwardly to normally close the valve by means of coil springs 91 and 92 disposed within the chamber and acting between its upper end and a piston 93 connected to the upper end of the stem for sealably sliding within the chamber. The stem carries a seal ring 98 which sealably slides within an opening 99 in the tool body connecting the space thereof above closure member 79 with the pressure chamber 94, and a bore 100 is formed through the closure member and stem to connect its lower end with the spring chamber above the piston.

The cross-sectional area of seat 78 is less than that of the effective sealing area of piston 93. Thus, when in the closed position, the safety valve will remain closed, regardless of whether pressure in the annulus from below the packer has leaked into the control chamber and in this further sense the valve is "fail safe". It will also be understood that the valve will remain closed even if one or more seals leak to equalize pressure within the annulus below the packer with control pressure.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for controlling flow within the annulus about a tubing string suspended within a well bore, comprising body means having a bore therethrough adapted to be connected as port of the tubing string and a pocket to one side of the bore having an end opening to said bore, a packer for sealing between the body means and the well bore, means which by-passes the packer for connecting the annulus above and below the packer, valve means for opening and closing a flow path through said connecting means, fluid responsive means for moving said valve means from normally closed to open position, said moving means being carried within a tool which is adapted to be moved vertically through the tubing string into and out of landed position within the pocket, and means through which control fluid may be supplied through a line leading from a remote source to said fluid responsive means, when said tool is so landed, in order to open said valve means.

2. Apparatus of the character definded in claim 1, wherein said valve moving means includes means for maintaining said valve means closed, whether fluid pressure in the annulus above or below the packer is predominant, until it is moved to open position by said control fluid.

3. Apparatus of the character defined in claim 1, wherein said body means includes a tubing hanger about which the packer is disposed, and a mandrel in which the pocket is formed, said mandrel being releasably connected to the tubing hanger, and said mandrel and tubing hanger have openings therein which connect to form portions of said bore and connecting means when the mandrel and tubing hanger are releasably connected.

4. Apparatus of the character definded in claim 1, including a check valve which closes a second flow path through said connecting means when the pressure fluid in the annulus below the packer exceeds that in the annulus above the packer, but which opens said second flow path when the pressure above exceeds that below by a predetermined amount, so as to increase the flow through said connecting means when said valve means is open.

5. Apparatus for controlling flow within the annulus about a tubing string suspended within a well bore, comprising body means having a bore therethrough adapted to be connected as part of the tubing string and a pocket to one side of the bore having an end opening to said bore, a packer for sealing between the body means and the well bore, means which by-passes the packer for connecting the annulus above and below the packer, a tool adapted to be moved vertically through the tubing string into and out of landed positions within the pocket, said tool carrying valve means for opening and closing a flow path through said connecting means, and fluid responsive means for moving said valve means from normally closed to open position, and means through which control fluid may be supplied through a line leading from a remote source to said valve fluid responsive means, when said tool is so landed in order to open said valve means.

6. Apparatus of the character defined in claim 4, wherein said valve moving means includes means for maintaining said valve means closed, whether fluid pressure in the annulus above or below the packer is predominant, until it is moved to open position by said control fluid.

7. Apparatus of the character defined in claim 4, wherein said body means includes a tubing hanger about which the packer is disposed, and a mandrel in which the pocket is formed, said mandrel being releasably connected to the tubing hanger, and said mandrel and tubing hanger have openings therein which connect to form portions of said bore and connecting means when the mandrel and tubing hanger are releasably connected.

8. Apparatus of the character defined in claim 4, including a check valve which closes a second flow path through said connecting means when the pressure of fluid in the annulus below the packer exceeds that in the annulus above the packer, but which opens said second passageway when the pressure above exceeds that below by a predetermined amount, so as to increase the flow through said connecting means when said valve means is open.

9. Apparatus of the character defined in claim 8, wherein said check valve is also carried by said tool.

10. Apparatus for controlling flow within the annulus about a tubing string suspended within a well bore, comprising body means having a bore therethrough adapted to be connected as part of a tubing string, a packer for sealing between the body means and the well bore, said body means having a portion above the packer whose outer cylindrical diameter is eccentric to the axis of its bore to provide a radially thickened well to one side of its bore, means which by-passes the packer for connecting the annulus above and below the packer, valve means for opening and closing a flow path through said connecting means, means for moving said valve means from normally closed to open position, including a pressure chamber within the radially thickened wall of the body means, and piston means connected to the valve means and movable within the chamber for opening said valve means in response to the supply of fluid pressure to the chamber, and means through which control fluid may be supplied through a line leading from a remote source to said chamber in order to open said valve means.

11. Apparatus of the character defined in claim 10, wherein said valve moving means includes means within the thickened wall portion of said body means for maintaining said valve means closed, whether fluid pressure in the annulus above or below the packer is predominant, until it is moved to open position by said control fluid.

12. Apparatus of the character defined in claim 10, wherein said body means includes a tubing hanger about which the packer is disposed, and a mandrel having the thickened wall in which the pressure chamber is disposed, said mandrel being releasably connect to the tubing hanger, and said mandrel and tubing hanger have openings therein which connect to form portions of said bore and connectings means when the mandrel and tubing hanger are releasably connected.

13. Apparatus of the character defined in claim 10, including a check valve which closes a second flow path through said connecting means when the pressure of fluid in the annulus below the packer exceeds that in the annulus above the packer, but which opens said second passage path when the pressure above exceeds that below by a predetermined amount, so as to increase the flow through said connected means when said valve means is open.

14. Apparatus of the character defined in claim 10, wherein said valve means is also within said thickened wall portion of the body means.

15. Apparatus of the character defined in claim 14, wherein said valve moving means includes means within the thickened wall portion of said body means for maintaining said valve means closed, whether fluid pressure in the annulus above or below the packer is predominant, until it is moved to open position by said control fluid.

16. Apparatus of the character defined in claim 14, wherein said body means includes a tubing hanger about which the packer is disposed, and a mandrel having the thickened wall in which the pressure chamber is disposed, said mandrel being releasably connected to the tubing hanger, and said mandrel and tubing hanger have openings therein which connect to form portions of said bore and connecting means when the mandrel and tubing hanger are releasably connected.

17. Apparatus of the character definded in claim 14, including a check valve within said thickened wall portion which closes the second flow path when the pressure of fluid in the annulus below the packer exceeds that in the annulus above the packer, but which opens said second passage path when the pressure above exceeds that below by a predetermined amount, so as to increase the flow through said connecting means when said valve is open.

18. Apparatus for controlling flow within the annulus about a tubing string within a well bore, wherein a lower portion of the tubing string is suspended from a tubing hanger having a bore therethrough and an opening which by-passes a packer sealing between the hanger and the well bore, said apparatus comprising a mandrel adapted to be suspended from an upper portion of tubing string and having means on its lower end for releasably connecting it to the hanger, said mandrel having a bore therethrough which is aligned with the hanger bore and an opening therein which is aligned with the opening in the tubing hanger to provide means which by-passes the packer for connecting the annulus above and below said packer when said mandrel is releasably connected to said hanger, said mandrel also having a pocket therein on one side of its bore and an end opening to the bore, valve means for opening and closing a flow path of the connecting means, fluid responsive means for moving said valve means from normally closed to open position, said moving means being carried within a tool which is adapted to be moved vertically through the tubing string into and out of landed position within the pocket, and means through which control fluid may be supplied through a line leading from a remote source to said valve moving means, when said tool is so landed in order to open said valve means.

19. Apparatus of the character defined in claim 18, wherein said valve moving means includes means for maintaining said valve means closed, whether fluid pressure in the annulus above or below the packer is predominant, until it is moved to open position by said control fluid.

20. Apparatus of the character defined in claim 18, including a check valve which closes a second flow path of said connecting means when the pressure of fluid in the annulus below the packer exceeds that in the annulus above the packer, but which opens said second passage path when the pressure exceeds that below by a predetermined amount, so as to increase the flow through said connecting means when said valve means is open.

21. Apparatus for controlling flow within the annulus about a tubing string within a well bore, wherein a lower portion of the tubing string is suspended from a tubing hanger having a bore therethrough and an opening which by-passes a packer sealing between the hanger and the well bore, said apparatus comprising a mandrel adapted to be suspended from an upper portion of tubing string and having means on its lower end for releasably connecting it to the hanger, said mandrel having a bore therethrough which is is aligned with the hanger bore and an opening therein which is aligned with the opening in the tubing hanger to provide means which by-passes the packer to connect the annulus above and below said packer when said mandrel is releasably connected to said hanger, said mandrel also having a pocket therein on one side of its bore and an end opening to the bore, a tool adapted to be moved vertically through the tubing string into and out of landed position within the pocket, said tool carrying valve means for opening and closing a flow path of said connecting means, and fluid responsive means for moving said valve means from normally closed to open position, and means through which control fluid may be supplied through a line leading from a remote source to said valve fluid responsive means, when said tool is so landed, in order to open said valve means.

22. Apparatus of the character defined in claim 21, wherein said valve moving means includes means for maintaining said valve means closed, whether fluid pressure in the annulus above or below the packer is predominant, until it is moved to open position by said control fluid.

23. Apparatus of the character defined in claim 21, including a check valve which closes a second flow path of said connecting means when the pressure of fluid in the annulus below the packer exceeds that in the annulus above the packer, but which opens said second passage path when the pressure above exceeds that below by a predetermined amount, so as to increase the flow through said connecting means when said valve means is open.

24. Apparatus of the character defined in claim 23, wherein said check valve is also carried by said tool.

25. Apparatus for controlling flow within the annulus about a tubing string within a well bore, wherein a lower portion of the tubing string is suspended from a tubing hanger having a bore therethrough and an opening which by-passes a packer sealing between the hanger and the well bore, said apparatus comprising a mandrel adapted to be suspended from an upper portion of tubing string and having means on its lower end for releasably connecting it to the hanger, said mandrel having a bore therethrough which is aligned with the hanger bore and an opening therein which is aligned with the opening in the tubing hanger to provide means which by-passes the packer to connect the annulus above and below said packer when said mandrel is releasably connected to said hanger, said mandrel also having a portion whose outer cylindrical diameter is eccentric to the axis of its bore to provide a radially thickened wall to one side of its bore, valve means for opening and closing the connecting means, means for moving said valve means from normally closed to open position, including a pressure chamber within the radially thickened wall of the body means, and piston means connected to the valve means and movable within the chamber for opening said valve means in response to the supply of fluid pressure to the chamber, and means through which control fluid many be supplied through a line leading from a remote source to said chamber in order to open said valve means.

26. Apparatus of the character defined in claim 25, wherein said valve moving means includes means within the thickened wall portion of said body means for maintaining said valve means closed, whether fluid pressure in the annulus above or below the packer is predominant, until it is moved to open position by said control fluid.

27. Apparatus of the character defined in claim 25, including a check valve which closes a second flow path of said connecting means when the pressure of fluid in the annulus below the packer exceeds that in the annulus above the packer, but which opens said second passage when the pressure above exceeds that below by a predetermined amount, so as to increase the flow through said connecting means when said valve means is open.

28. Apparatus of the character defined in claim 25, wherein said valve means is also within said thickened wall portion of the body means, and said connecting means includes passageways in said thickened wall portion leading to and from said valve means.

29. Apparatus of the character defined in claim 28, wherein said valve moving means includes means within the thickened wall portion of said body means for maintaining said valve means closed, whether fluid pressure in the annulus above or below the packer is predominant, until it is moved to opening position by said control fluid.

30. Apparatus of the character defined in claim 28, including a check valve within said thickened wall portion which closes a second flow path of said connecting means when the pressure of fluid in annulus below the packer exceeds that in the annulus above the packer, but which opens said second passage path when the pressure above exceeds that below by a predetermined amount, so as to increase the flow through said connecting means when said valve means is open.

31. Apparatus for controlling fluid within the annulus about a tubing string suspended within a well bore, comprising body means having a bore therethrough adapted to be connected as part of the tubing string, a packer for sealing between the body means and the well bore, and means in the body means which by-passes the packer for connecting the annulus above and below the packer, valve means normally closing a first flow path of said connecting means, fluid responsive means for moving said valve means to opening position, means through which control fluid may be supplied through a line leading from a remote source to said moving means for opening said valve means, and a check valve which closes a second flow path of said connecting means when the pressure of fluid in the annulus below the packer exceeds that in the annulus above the packer, but which opens said second flow path when the pressure exceeds that below by a predetermined amount, so as to increase the flow through said connecting means when said valve means is open.

32. For use in apparatus which comprises body means having a bore therethrough connected as part of a tubing string suspended within a well bore, a packer for sealing between the body means and the well bore, means in the a body means which by-passes the packer to connect the annulus above and below the packer, and a pocket in the body means to one side of the bore having an end which opens to the bore; a tool adapted to be moved vertically through the tubing string into and out of landed position within the pocket, said tool carrying normally closed valve means for controlling flow through a flow path of said connecting means, and means which is responsive to control fluid supplied thereto through a line leading from a remote source when said tool is so landed, in order to move said valve means to open position.

33. A tool of the character defined in claim 32, wherein said tool has a passageway therein adapted to form a continuation of the flow path in the body means, and said valve means includes a closure member which is movable within the tool between positions opening and closing the tool flow path.

34. A tool of the character defined in claim 33, wherein said valve moving means includes means for maintaining said valve means closed, whether fluid pressure in the annulus above or below the packer is predominant, until it is moved to open position by said control fluid.

35. A tool of the character defined in claim 34, including a check valve which closes a second flow path of said connecting means when the pressure of fluid in the annulus below the packer exceeds that in the annulus above the packer, but which opens when the pressure above exceeds that below by a predetermined amount, so as to increase the flow through said connecting means when said valve means is open.

36. Apparatus for controlling flow within the annulus about a tubing string within a well bore, comprising body means having a bore therethrough adapted to be connected as part of the tubing string, a packing element about the body means, said body means including means operable in response to tubing pressure for expanding the packing element into engagement with the well bore, a passageway which by-passes the packing element to connect with the annulus beneath the packer, means for releasably locking the packing element expanding means against operations to expand the packing element, means for holding the locking means in locking position, said holding means including a piston which is disposable within the passageway to close it, so that the fluid pressure supplied to the closed passageway will urge the holding means to a position for releasing the locking means, whereby the packing element may be expanded, and the piston moved out of the passageway to open it, means through which control fluid may be supplied to the body means through a line leading from a remote source, and means for alternatively connecting said control line with the closed passageway, in order that the holding means may be released, and disconnecting the control line with either the annulus or said passageway in order that said control fluid may be supplied to one or more other pressure responsive mechanisms within the well bore.

37. Apparatus of the character defined in claim 36, wherein the means for disconnecting the control line with said passageway includes means for connecting the annulus above the packing element with the passageway.

38. Apparatus of the character defined in claim 37, wherein valve means is disposed within said connecting means for controlling circulation through said passageway.

39. Apparatus of the character defined in claim 38, wherein said valve means is normally closed and includes means for opening it in response to the supply of said control fluid thereto.

40. Apparatus of the character defined in claim 36, wherein said connecting and disconnecting means includes a pocket in the body means to one side of its bore, ports in the body means connecting said pocket with each of the passageway, control line and the annulus above the packer, and a pair of tools each adapted to be moved vertically through the tubing string into and out of the pocket, when the other is removed therefrom, one such tool connecting the control line port with the passageway port, and the other such tool disconnecting the control line port with either the annulus port or the passageway port.

41. Apparatus of the character defined in claim 40, wherein said other tool connects the annulus port with the passageway port.

42. Apparatus of the character defined in claim 41, wherein valve means is carried with said other tool for controlling circulation through said passageway.

43. Apparatus of the character defined in claim 42, wherein said valve means is normally closed and includes means for opening it in response to the supply of said control fluid thereto.

44. Apparatus of the character defined in claim 36, wherein the body means includes a lower hanger portion about which the packing element is carried, an upper mandrel portion in which the connecting and disconnecting means is carried, and means for connecting said portions in end-to-end relation, said portions having bores therethrough and opening which are aligned so as to form the bore and passageway when said portions are so connected.

45. For use in closing off an annular space about a pipe string suspended within a well bore, a packer comprising body means including a tubular member adapted to be connected as part of the pipe string, and a sleeve surrounding the tubular member, a normally contracted packing element carried about the body means, means for expanding the packing element into engagement with the well bore in response to axial movement of said sleeve with respect to the tubular member, means forming a pressure chamber within the body means including a piston on the sleeve, said tubular member having a port therein connecting its bore with the chamber so that tubing pressure acts over the piston to urge said sleeve to move with respect to said tubular member, means forming a passageway within the body means having an upper end adapted to be connected with a line for supplying control fluid from a remote source, and a lower end connecting with the exterior of the body means beneath the packing element so as to bypass same, locking means on the sleeve engageable with locking means on the tubular member so as to prevent the sleeve from moving, means for holding said locking means in locking engagement, and means for moving said holding means to a position in which it releases said locking means for disengagement from locking position, including a piston on the holding means which is disposable within said passageway to close it so that control fluid may be supplied thereto to move the holding means to locking means releasing position, whereby the packing element may be expanded and the piston on the holding means moved out of the passageway to open it.

46. Apparatus of the character defined in claim 45, wherein said holding means comprises a sleeve depending from the piston thereof to surround the locking parts, when in holding position, an intermediate portion of the sleeve of the hold means being relieved to release the locking parts as said sleeve is lowered.

47. Apparatus for controlling flow within the annulus about a tubing string within a well bore, comprising body means having a bore therethrough adapted to be connected as part of the tubing string, a packing element about the body means, means for expanding the packing element into engagement with the well bore, means including conduit means for connecting the annulus above and below the packer element when the packing element is so expanded, means for releasably locking the packing element expanding means against operation to expand the packing element, first pressure responsive means for releasing the locking means in response to the supply of control fluid thereto, whereby the packing element may be expanded, valve means for opening and closing the connecting means, second pressure responsive means for controlling the valve means in response to the supply or exhaust of control fluid thereto, and means by which control fluid may be alternatively supplied through a control line leading from a remote source to the first pressure responsive means in order to release the locking means, and, upon expansion of the packing element, to said second pressure responsive means to open or close the valve means.

48. Apparatus of the character defined in claim 47, wherein said valve means is normally urged closed and is opened by the second pressure responsive means in response to the supply of said control fluid thereto.

49. Apparatus of the character defined in claim 47, wherein said body means includes a pocket to one side of the bore therethrough, and the means by which control fluid may be supplied includes a pair of tools each adapted to be moved through the tubing string into and out of the pocket when the other is removed therefrom, said body means and a first of the tools cooperating to supply control fluid to said first pressure responsive means, and said body means and the second of the tools cooperating to supply control fluid to said second pressure responsive means.

50. Apparatus of the character defined in claim 49, wherein the connecting means includes conduit means in the second tool, and the valve means is mounted in the second tool for controlling flow through the conduit means therein.

51. Apparatus of the character defined in claim 49, wherein the means by which control fluid may be supplied to the first and second pressure responsive means includes a port in the body means to which a single control line leading from the remote source of pressure may be connected.

52. Apparatus of the character defined in claim 49, wherein the packing expanding means includes a means responsive to the supply of fluid pressure thereto through the tubing string.

53. Apparatus for controlling flow within the annulus about a tubing string within a well bore, comprising body means having a bore therethrough adapted to be connected as part of the tubing string, a packing element about the body means, means for expanding the packing element into engagement with the well bore, means for releasably locking the packing element expanding means against operation to expand the packing element, first pressure responsive means for releasing the locking means in response to the supply of control fluid thereto, whereby the packing element may be expanded, said body means having a pocket therein to one side of the bore therethrough, and a first tool adapted to be moved through the tubing string into and out of the pocket, said body means and first tool having conduit means through which control fluid from a remote source may be supplied to the first pressure responsive means, when said first tool is in the pocket, means including conduit means for connecting the annulus above and below the packer element when the packing element is so expanded, valve means for controlling flow through the connecting means, a second tool adapted to be moved through the tubing and into the pocket upon removal of the first tool therefrom, and having second pressure responsive means for opening and closing the valve means in response to the supply of control fluid thereto from a remote source.

54. Apparatus of the character defined in claim 53, wherein the connecting means includes conduit means in the second tool, and the valve means is mounted in the second tool for controlling flow through the conduit means therein.

55. Apparatus of the character defined in claim 53, wherein the packing expanding means includes means responsive to the supply of fluid pressure thereto through the tubing string.

56. Apparatus of the character defined in claim 53, wherein the conduit means in the body means through control fluid may be supplied to the first and second pressure responsive means comprises a port to which a single control line leading from the remote source may be connected.

* * * * *